United States Patent [19]

Sable

[11] Patent Number: 4,809,777

[45] Date of Patent: Mar. 7, 1989

[54] WELL TOOL

[76] Inventor: Donald E. Sable, 14175 Proton Rd., Dallas, Tex. 75244

[21] Appl. No.: 2,767

[22] Filed: Jan. 12, 1987

Related U.S. Application Data

[63] Continuation-in-part of Ser. No. 890,141, Jul. 28, 1986, abandoned.

[51] Int. Cl.[4] ..... E21B 17/10

[52] U.S. Cl. ..... 166/241; 175/325

[58] Field of Search ..... 166/241, 242, 243, 176, 166/902; 175/76, 323, 325

[56] References Cited

U.S. PATENT DOCUMENTS

| | | | |
|---|---|---|---|
| 2,094,897 | 10/1937 | Leidecker | 166/176 |
| 2,466,239 | 4/1949 | Holcombe | 166/176 |
| 2,583,044 | 1/1952 | Earl | 166/176 |
| 2,659,439 | 11/1953 | Baker | 166/241 |
| 3,250,578 | 5/1966 | Lubbes | 175/325 |
| 3,282,344 | 11/1966 | Tripplehorn | 175/325 |
| 3,490,526 | 1/1970 | Collett | 166/176 |
| 4,088,185 | 5/1978 | Carson | 166/241 |
| 4,621,690 | 11/1986 | Klyne | 166/241 |

FOREIGN PATENT DOCUMENTS

| | | | |
|---|---|---|---|
| 3130580 | 10/1982 | Fed. Rep. of Germany | 166/241 |
| 0899835 | 1/1982 | U.S.S.R. | 166/241 |

OTHER PUBLICATIONS

Reamco Inc. 1978–79 Catalog, Multi-Blade Stabilizers, 5482–5499.

*Primary Examiner*—Jerome W. Massie
*Assistant Examiner*—Terry Lee Melius

[57] ABSTRACT

A centralizer for pump rod string which minimizes the resistance offered thereby to flow of well fluids therepast having two pairs of longitudinally and circumferentially spaced radially outwardly extending ribs.

5 Claims, 2 Drawing Sheets

WELL TOOL

This application is a continuance in a part of pending application of Donald E. Sable filed 7/28/86, Ser. No. 890,141 now abd.

BACKGROUND OF THE INVENTION

This application relates to well tools and more particularly to centralizers and/or scrapers for pump rod strings.

The usual apparatus for pumping well fluids from a well to the surface, through a tubing which extends from the surface to below a fluid producing formation penetrated by the well, includes a pump connected to the lower end of the tubing which has a plunger or "traveling valve" which is reciprocated in the longitudinal barrel of the pump by a string of pump rods, the bottom rod being connected to the traveling valve, the top rod of the rod string being connected to a motor driven means for alternately pulling the string upwardly and then allowing the string to be moved downwardly by gravity.

Since the weight of the tubing string, of the pump rod string provides the force necessary to cause well fluids to flow upwardly through the tubing, if the resistance to the downward movement of string of tubing by the upwardly flowing well fluids, especially past such obstructions to fluid flow as centralizers or scrapers mounted on the rods, the rod string will move downwardly relatively slowly thus reducing the rate of production of the well fluids. The centralizers decrease the flow space area between the centralizers, the rod and the tubing. In addition, if the pump and lower end portions of the rod string offer a relatively great resistance to downward movement of the rod string, the weight of upper portions of the rod string may cause lower portions of the rod string to be placed under great compression loads which tend to cause such lower portions to bend and buckle and their centralizers to be moved with great force against the internal surfaces of the tubing.

In addition, the bottom end portion of the rod string must be held in concentric longitudinal alignment with the pump plunger both to minimize wear of the pump lunger and barrel and to decrease the resistance to downward movement of the plunger in the barrel.

OBJECTS OF THE INVENTION

It is therefore an object of this invention to provide centralizer means on the rods of the pump rod string which will hold the rods in central longitudinal alignment with and in the tubing while presenting a minimal resistance to the upward flow of fluids therepast.

Another object is to provide centralizers which have no downwardly facing surfaces which extend transversely perpendicularly to the vertical axis of the rod, such surfaces creating turbulence and resistance to upward fluid flow past the centralizers and thus increases resistance to downward movement of the rod string in the tubing.

An important object of the invention is to provide a centralizer which provides an relatively large flow space area between the centralizer and the internal surface of the tubing.

Another object of the invention is to provide a centralizer having vertically spaced pairs of radially outwardly extending opposed ribs, one pair being displaced 90 degrees from the other relative to the central longitudinal axis of the centralizer, thus providing a much larger flow space area between the centralizer and the tubing then if the ribs were not so vertically spaced.

SUMMARY OF THE INVENTION

The centralizer of the invention is formed of a durable plastic and is moulded rigidly on the pump rod having a longitudinal body and an upper pair of opposite ribs extending outwardly from the body in opposite directions and a pair of similar ribs displaced 90 degrees on the body relative to the upper pair. The bottom ends of the upper ribs are spaced from the top ends of the lower ribs. The upwardly and downwardly facing surfaces of the body extending outwardly, and downwardly and outwardly, respectively, the upwardly and downwardly facing surfaces of the ribs similarly extending from the body outwardly, and downwardly and upwardly, respectively.

A short "pony" pump rod provided with several vertically spaced centralizers for use as the bottom rod of the string holds the bottom end portion of the pump rod string in vertical and central alignment with the plunger of the pump.

DESCRIPTION OF THE DRAWINGS

Other objects and advantages of the invention will be readily apparent from the reading of the following description of a centralizer constructed in accordance with the invention and reference to the accompanying drawings, wherein.

DESCRIPTION OF THE EMBODIMENT OF THE INVENTION

Figure 1:
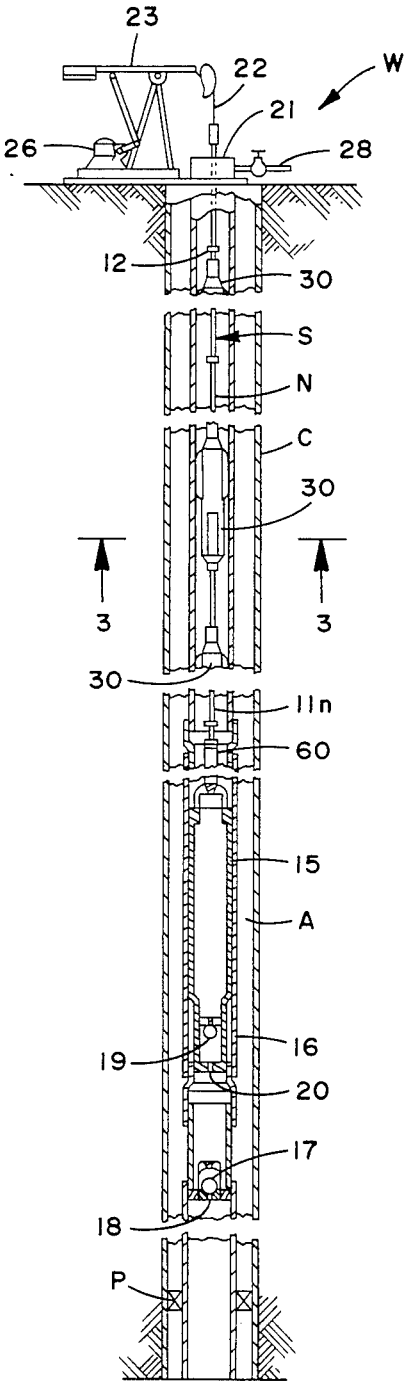
FIG. 1 is a vertical, sectional schematic view of a well whose pump rod string is provided with the centralizers embodying the invention.

Referring now to the drawings, the pumping apparatus 10 is shown in use to pump liquids from a well W to the surface through a string of tubing T which extends through the well casing C to the surface, the annulus A between the string of tubing and the casing adjacent the lower end of the tubing being closed by a packet P. The pumping apparatus includes an operator member or string S of sucker rods 11 which are connected to one another by the usual box or socket connections 12. The bottom end of the lowermost sucker rod 11n is connected to the plunger 15 of any suitable pump P, the plunger being telescoped in the barrel 16 of the pump. The barrel is provided with a check valve 17, usually referred to as the "standing valve", which permits upward flow into the barrel 16, but prevents downward flow therefrom through the downwardly opening inlet 18 of the barrel while the hollow plunger is provided with a check valve 19, usually referred to as the "traveling valve", which permits upward flow through the inlet 20 of the plunger and prevents downward flow through the inlet into the barrel.

It will be apparent that when the plunger is in its lowermost position relative to the barrel and is moved upwardly, the well fluids are drawn from the open lower end of the tubing, which is in communication with a producing formation of the well upwardly into the barrel, the standing valve 17 moving to its open position and the traveling valve 19 closing. During this upward movement of the plunger, the plunger moves upwardly in the tubing and moves the well fluids thereabove upwardly. When the plunger is in its upper most position relative to the barrel and is moved downwardly therein, the standing valve closes to prevent downward flow of well fluids from the barrel through the aperture 18 and the traveling valve opens to permit the well fluids in the barrel to flow upwardly into the hollow plunger and then upwardly to the tubing thereabove. During this downward movement of the plunger, the string of sucker rods also moves downwardly through the tubing and therefore during the downward stroke the well fluids are also caused to flow upwardly in the tubing above the plunger as the plunger displaces the well fluids in the barrel upwardly and as an additional length of the sucker rod string moves into the tubing at the surface.

The top end of the top sucker rod of the string extends upwardly through the wellhead 21 and is connected by a flexible member or cable 22 to one end of the usual walking beam 23, the cable extending past the usual horsehead of the beam. The walking beam is oscillated about its pivot 25 by a prime mover, such as an electric motor 26, by a suitable linkage 27. This means for reciprocating the sucker rod string in the tubing being well known, it will not be described in detail. The well fluids pumped from the well are transmitted to a suitable reservoir or point of use by the pipe 28 which is connected to the well head.

Each of the pump rods of the string S is provided with one or more centralizers 30 of the invention.

Figure 2:
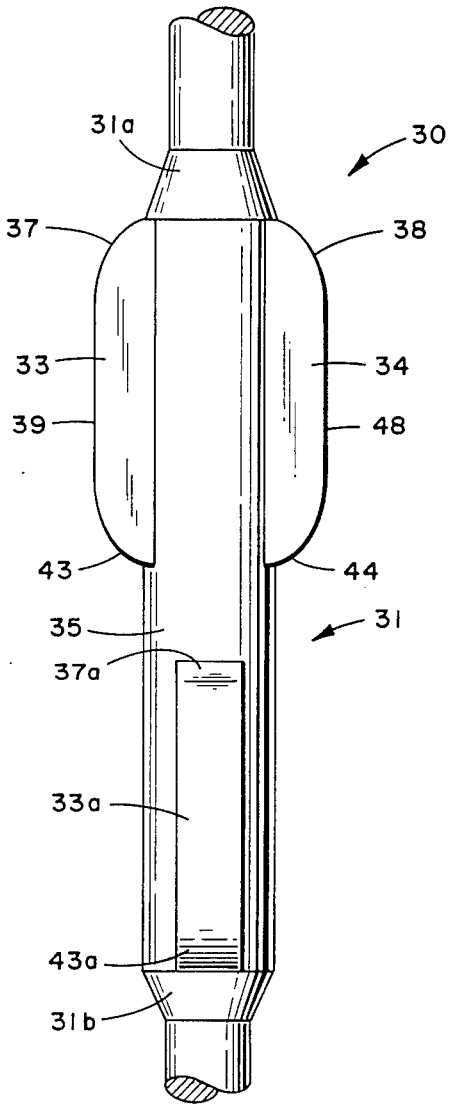
FIG. 2 is a longitudinal plan view of the centralizer embodying the invention.

Each of the centralizers, FIG. 2, has a body 31 whose opposite end surfaces 31*a* and 31*b* extend divergently inwardly to the rod. An upper pair of ribs 33 and 34 extend radially outwardly from the circular outer surface 35 of the body in opposite directions.

The top end surfaces 37 and 38 of the ribs 33 and 34, respectively, extend arcuately and downwardly from the lower end of the top surface 31*a* to the vertical surfaces 39 and 40 of the ribs 37 and 34, respectively.

Similarly, the bottom surfaces 43 and 44 of the ribs 33 and 34, respectively, curve downwardly and inwardly from the lower ends of their vertical surfaces 39 and 40, respectively, to the surface 35 of the body.

The outer vertical surfaces of the ribs lie in a circle whose diameter is slightly less than the internal diameter of the tubing in which the pump rods are to be used.

The lower pairs of ribs 33*a* and 34*a* have the same configuration as the upper ribs and accordingly the various surfaces of the ribs 33*a* and 34*a* are provided with the same reference numbers to which the subscription "a" has been added, as the corresponding surfaces of the ribs 33 and 34, respectively.

The top ends of the lower ribs are spaced from the bottom ends of the top pair of ribs to facilitate flow of well fluids between the flow channels 51 and 52 defined by the ribs 33 and 34 and the flow channels 51*a* and 52*a* defined by the ribs 33*a* and 34*a*.

Prior art centralizers and scrapers, such as those illustrated in the U.S. Pat. No. 4,088,185 to Forrest L. Carson, have four ribs which are in vertical alignment so that the flow channels defined by adjacent ribs thereof are of relatively small cross sectional area as compared to the flow channels defined by the vertically spaced flow channels of the described and illustrated centralizer embodying the invention.

Figure 3:
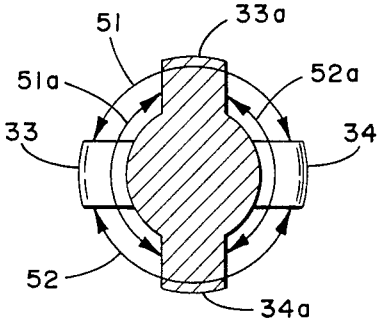
FIG. 3 is a cross-sectional view taken on line 3—3 of FIG. 1.

It will be seen in FIG. 3, that the ribs of the upper and lower pairs of ribs are of shorter width than the flow channels they define so that portions of the channels 51 and 52 are in alignment with flow channels 51*a* and 52*a*. As a result with the provisions of the vertical spacing between the pairs of upper and lower pairs of ribs, and the elimination of any surfaces which lie in a plane transverse to the longitudinal axis of the centralizer, the centralizer of the invention minimizes the resistance presented thereby to fluid flow therepast in the tubing.

The centralizers are formed of a tough durable plastic such as polyphenylene sulfide which is commercially available under the trademark Ryton, which is moulded on the pump rods. The Ryton substance, as it cools, tends to contract and grip the rods with a considerable compressive force. It will be evident that the greater the area of rod centralizer in contact with the rod, the greater will be the force with which it is held against movement on the rod. The described and illustrated centralizer has twice the length of conventional centralizers and obviously will resist displacement, as by inadvertent blows during make-up and break-down of a pump rod string, much better than conventional centralizers.

As illustrated in FIG. 1, in order to ensure as good a coaxial vertical alignment of the bottom portion of the pump rod string with the pump plunger rod 60, the bottom pump rod 11n is made of short "pony" length, e.g. six feet long, where standard length pump rods are eighteen feet long or longer.

The pony rod is provided with three or more centralizers so that it cannot be displaced laterally of the pump plunger even if subjected to very great laterally directed forces.

In present practice, attempts to achieve such alignment involves use of a fluted metal joint at the connection of the bottom end of the pump rod string with the pump plunger rod, which greatly restricts fluid flow and the metal to metal contact of such fluted metal joint with the interval surfaces of the tubing may cause excessive wear of the tubing and fluted joint.

In use, the pump rod string, provided with the centralizers embodying the invention, increases the rate of downward movement of the pump rod string by decreasing the cumulative resistance at all locations of the centralizers because of the much greater flow space areas of channels or passages defined by the vertically spaced pairs of ribs and the tubing.

In addition, the elimination of any surfaces of the centralizers which extend perpendicularly outwardly from the rod, reduces the turbulence at the instance of reversal from upward to downward transparent movement of the pump rod string.

Figure 4:
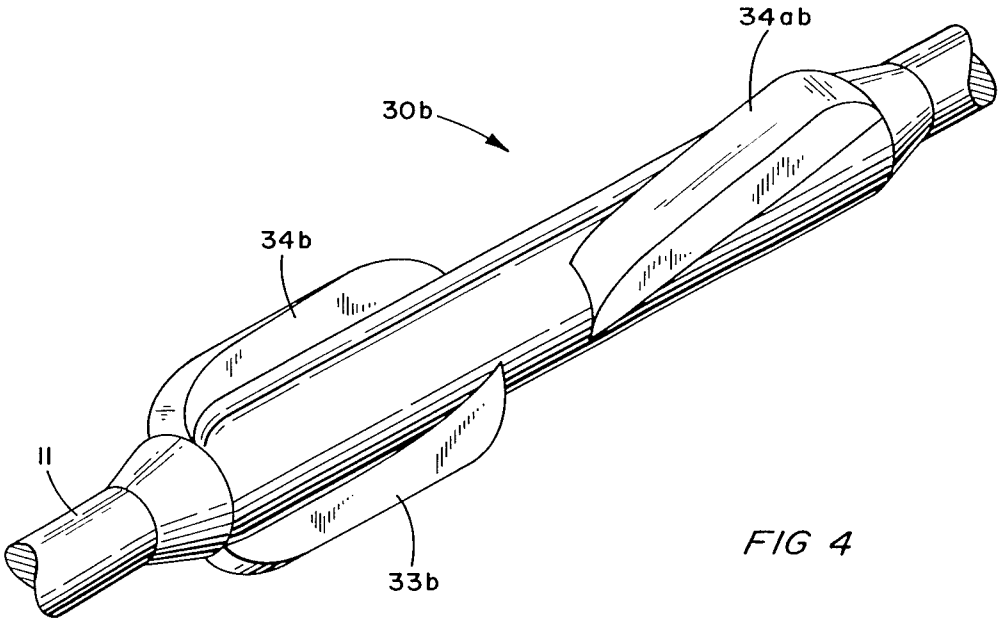
FIG. 4 is a perspective view of a modified form of the centralizer embodying the invention.

Referring now to FIG. 4 of the drawing, the scraper 30b has substantially the same configuration as the centralizer and accordingly, its elements have been provided with the same reference numerals to which the subscript "b" has been added, as the corresponding elements of the centralizer 30.

It will be seen that the scraper 30*b* differs from the centralizer 30 in that its pairs of ribs 33*b* and 34*b*, and 33*ab* and 34*ab* extend longitudinally at an angle to the central longitudinal axis of the body 31*b* so that the outer surfaces will cover the full internal circumference of the tubing. Such scrapers will, of course, also act as centralizers.

It will now be seen that new and improved well tools have been illustrated and described which are mounted on the rods of a pump rod string and which have opposite end portions which extend convergently outwardly of the rod to minimize turbulence and protect the rod below the well tool from corrosions, abrasions and the like caused by turbulence in the well fluids as explained in detail in the above identified pending application for Letters Patent of the United States.

The forgoing description of the invention is explanatory only and changes in the details of the construction illustrated may be made by those skilled in the art, within the scope of the appended claims, without departing from the spirit of the invention.

What is claimed as new and desired to be secured by Letters Patent is:

1. A well tool including: a pump rod and a centralizer having a cylindrical body rigidly mounted on said rod, an upper pair of ribs integral with said body and extending outwardly therefrom in opposite directions, and a lower pair of ribs integral with said body and extending outwardly therefrom in opposite directions, said lower pair of ribs being displaced on said body from said upper pair of ribs ninety degrees about the central longitudinal axis of said rod, top ends of said lower pair of ribs being spaced from bottom ends of said upper pair of ribs, each pair of ribs with said body defining outwardly opening channels, said channels having a greater width than said ribs whereby portions of the channels between said upper pair of ribs are in vertical alignment with portions of the channels between said lower pair of ribs, said body having opposite end portions extending divergently inwardly to said rod, said ribs having outer vertical surfaces and opposite end surfaces which extend arcuately and divergently to said cylindrical body.

2. The well tool of claim 1, wherein said body and ribs are formed of polyphenylene sulfide.

3. The well tool of claim 1 wherein said rod is connectible to the bottom of a string of pump rods and is of substantially shorter length than rods of a string, said rod being connectible to a plunger rod of a pump, said rod having a plurality of additional centralizers mounted thereon in vertically spaced relation to one another.

4. The well tool of claim 3, wherein each pair of ribs with said body defines outwardly opening channels, said channels having a greater width then said ribs whereby portions of the channels between said upper pair of ribs are in vertical alignment with portions of the channels between said lower pair of ribs.

5. The well tool of claim 1 wherein said pairs of ribs extend vertically at an angle to the longitudinal axis of said body.

* * * * *